US008066022B2

(12) United States Patent
Schlipf

(10) Patent No.: US 8,066,022 B2
(45) Date of Patent: Nov. 29, 2011

(54) PORTABLE BLIND AND CONCEALMENT SYSTEM

(75) Inventor: Jared Shane Schlipf, Dunlap, IL (US)

(73) Assignee: Oak Leaf Outdoors, Inc., Brimfield, IL (US)

( * ) Notice: Subject to any disclaimer, the term of this patent is extended or adjusted under 35 U.S.C. 154(b) by 0 days.

(21) Appl. No.: 12/767,500

(22) Filed: Apr. 26, 2010

(65) Prior Publication Data

US 2010/0269876 A1 Oct. 28, 2010

Related U.S. Application Data

(60) Provisional application No. 61/173,377, filed on Apr. 28, 2009.

(51) Int. Cl.
*E04H 15/48* (2006.01)

(52) U.S. Cl. ..... 135/147; 135/120.1; 135/901

(58) Field of Classification Search ..... 135/120.1, 135/120.3, 147, 901; 43/1–3
See application file for complete search history.

(56) References Cited

U.S. PATENT DOCUMENTS

| | | | | |
|---|---|---|---|---|
| 2,159,273 | A * | 5/1939 | Killinger | 135/125 |
| 2,744,348 | A | 5/1956 | Smith | |
| 3,164,344 | A | 1/1965 | Whyte | |
| 3,639,196 | A | 2/1972 | Hermanson | |
| 3,810,482 | A * | 5/1974 | Beavers | 135/147 |
| 3,829,349 | A | 8/1974 | Hermanson | |
| 3,928,689 | A | 12/1975 | Mottel | |
| 4,054,696 | A | 10/1977 | Crownover | |
| 4,496,615 | A | 1/1985 | Huang | |
| 4,798,019 | A * | 1/1989 | Sury et al. | 43/1 |
| 4,813,441 | A | 3/1989 | Kepley | |
| 5,342,661 | A | 8/1994 | Wilcox, II | |
| 5,628,338 | A | 5/1997 | Stumbo | |
| 6,037,021 | A | 3/2000 | Koo | |
| 6,099,920 | A | 8/2000 | Kao | |
| 6,116,563 | A | 9/2000 | Tsai | |
| 6,306,471 | B1 | 10/2001 | Pitman et al. | |
| 7,040,335 | B1 | 5/2006 | Ranso | |
| 7,225,823 | B1 | 6/2007 | Ransom et al. | |
| 7,371,442 | B2 | 5/2008 | Pitman | |
| 7,594,514 | B2 * | 9/2009 | Fereghetti et al. | 135/90 |
| 2006/0096630 | A1 * | 5/2006 | Eastman et al. | 135/115 |
| 2006/0207641 | A1 * | 9/2006 | Reis et al. | 135/87 |
| 2010/0229906 | A1 * | 9/2010 | Putman | 135/96 |

* cited by examiner

*Primary Examiner* — Noah Chandler Hawk
(74) *Attorney, Agent, or Firm* — Warner Norcross & Judd LLP

(57) ABSTRACT

A portable collapsible blind is provided including positioning members and simulated arborescent structures to break-up the hard geometric shape and lines of the blind. The positioning members can position the simulated arborescent structures to extend beyond at least one of a sidewall, side edge, upper edge, sidewall corner, roof edge, roof corner and roof a preselected distance. The simulated arborescent structure can include a limb and a leafy part suspended by the limb at a location distal from the geometric shape of the blind. A concealment pod also can be provided. The concealment pod can include a base with a plurality of outwardly projecting simulated arborescent structures. The base can include the fastener element that joins with a corresponding fastener element of a joining element. The base and joining element can be pivotally joined so that the simulated arborescent structures can be oriented in a variety of configurations.

19 Claims, 10 Drawing Sheets

PORTABLE BLIND AND CONCEALMENT SYSTEM

BACKGROUND OF THE INVENTION

The present invention relates to a concealment system, and more particularly, to a portable concealment system for blinds and other structures.

There are a variety of hunting and wildlife observation products that are adapted to conceal movement of a hunter or wildlife observer from game, such as deer, turkey and waterfowl. One such product is the ground blind.

Ground blinds include a frame covered by panels constructed of a camouflage material that blends in the natural surroundings. The frame and material usually form an enclosure in which a hunter or wildlife observer conceals themselves. The camouflage material is usually opaque so that a hunter can move within the enclosure without alerting game to the hunter or observer's presence within the blind.

Similarly, the military and police also use a variety of products to conceal the human form, equipment and/or machinery. For example, there are a variety of camouflage netting systems that are adapted to drape over equipment. The netting systems include camouflage patterns that blend in with natural surroundings so that the equipment is concealed from view.

Most conventional hunting ground blinds have an unnatural-looking, cubical or box-shaped geometric shape. An example of a box-shaped, hub-style blind is shown in U.S. Pat. No. 5,628,338 to Stumbo. Such a box-shaped blind appears out of place and unnatural in most wildlife environments, where near-perfect geometric shapes are uncommon. If not concealed, wildlife is usually able to readily identify such a blind. Deer, turkey and waterfowl are particularly adept at identifying conventional box-shaped ground blinds, given their prevalence in recent years. Many times, game will keep a safe distance from identified ground blinds, and accordingly, thwart the hunters or wildlife observer's attempts at harvesting or observing the game.

Typically, hunters will use natural foliage, such as brush, trees, shrubs, and cattails crudely laid against or over the ground blind to "brush in" and better conceal the ground blind. Many times, however, the collection of these items and concealment of the blind takes time, and can be particularly difficult to do quietly, which may alert nearby game to the hunter's presence. Moreover, collecting foliage in the area can spread the scent of the hunter, which can reduce the likelihood of a successful hunt, particularly if the blind is hunted soon after brushing it in.

Recently, manufacturers have begun to add strips of fabric that are cut in the shape of leaves around the hard corners or edges of ground blinds. These leaves usually project about an inch or two from the corners or edges. Even with these fabric leaves, from a distance, the geometric shape of the ground blind remains readily recognizable. Accordingly, even with a leafy cut-out fabric on the blind, many hunters still brush in the ground blind, which causes the above-mentioned noise, sight and scent issues, thereby reducing the likelihood of game observation and/or harvest from the blind.

SUMMARY OF THE INVENTION

A concealment system is provided to effectively hide or conceal human movement, the human form and/or other structures, such as machinery, equipment or vehicles.

In one embodiment, the concealment system is incorporated into a hunting or wildlife observation blind, referred to herein as a "blind." The blind can be portable and collapsible, and generally of the hub-style variety. The blind can include one or more walls and an optional roof. The blind can be configurable in a collapsed mode in which the blind is usually transported, and a erected mode in which the blind is fully erected and ready for concealment. The blind can also include one or more simulated arborescent structures which generally include a limb and a leafy part joined with the limb. The limb and/or leafy part can extend beyond the physical borders such as corners and edges of the blind to effectively break up its geometric shape, thereby blending the blind in with natural surroundings.

In another embodiment, the blind can include frame having positioning members that position the limbs in a fixed orientation relative to the walls and/or roof of the blind. When the blind is in the erected mode, one or more limbs extend beyond the geometric shape a sufficient distance to visually break up the geometric shape so that the blind is difficult to perceive. For example, and the limbs and/or leafy parts can extend 3 inches to 3 feet or more beyond edges or corners, or walls or a roof, of the blind.

In yet another embodiment the positioning members can be configured to align the limbs of the simulated arborescent structures so that they are generally parallel to corners or edges of the blind, and/or to support members of a frame. Accordingly, the positioning members can generally align multiple limbs with one another, as well as the support members of the frame, to aid in the collapsing of the frame and/or blind to a collapsed state.

In still another embodiment, the positioning member can include a sleeve that is joined with the material that forms the walls and roof of the blind. The sleeve can include an open end so that a portion of the arborescent structure can be inserted in and retained by the sleeve. Optionally, the limbs are readily replaceable and removable relative to the positioning member so that leaves of different camouflage patterns and colors can be readily swapped out to match different environments in which the blind is used. Thus, the same blind can sometimes be used to hunt deer or turkey in a woodland, waterfowl in a marsh, antelope in the desert, and a variety of other animals in other environments.

In another embodiment, the limb of the simulated arborescent structures can include a wire or rod embedded in a plastic or composite material. The limbs can be formable in a number of desired configurations. The leafy parts can include from a different wire or rod, formed, for example from a harder material or metal, such as spring steel. The leafy parts also include can a fabric that is joined with the wire or rod. When used with the blind, the limbs and leafy parts are adapted to resume a full and extended state, so that when the blind is erected, these elements extend beyond the boundaries and peripheries of the geometric shape of the blind. Accordingly, the blind readily attains a "brushed in" appearance without significant work on the part of the user.

In yet a further embodiment, the blind can include a concealment pod, or "star", joined with the blind at pre-selected locations. The concealment pod can include a base having multiple mounting members to which the simulated arborescent structures can be joined. A joining element can be joined with a base opposite the simulated arborescent structures. The joining element can be pivotally joined with the base, and thus rotatable to reorient the simulated arborescent structures, relative to a structure such as the blind, to which the pod is joined. Accordingly, the simulated arborescent structure can provide a desired camouflaging effect to the structure and/or blind.

In still a further embodiment, the concealment system can include a stand-alone pod that is attachable to a variety of structures, including the above noted blind, as well as vehicles, equipment and the like, to provide concealment and to break up the visual geometric shape appearance of the structure.

In another, further embodiment, the pod can include a stimulated arborescent structure including a limb joined with one or more of the mounting members and radially projecting outward from the base. Optionally, the base can define multiple bores in which the limbs of the simulated arborescent structures can be inserted and retained. The bores can retain the limb with either a friction fit, or a fastener joined with the mounting members and/or the limb. Further optionally, the simulated arborescent structures can include ends that are molded within the base, and held there by virtue of such molding. Even further optionally, the simulated arborescent structures can include ends that are simply joined with one another to form a base which defines a fastener element. The fastener element can physically join the base with a joining element that can further attach the base and arborescent structures with a structure such as a blind, for example.

In yet another, further embodiment, the joining element can define a slot sized to accept a web or other structure so that the pod can be readily joined with the web or structure.

In still another, further embodiment, the joining element can define a clip having a biasing member and opposing jaws. The biasing member can be adapted to urge the jaws to a closed position, thereby clamping a portion of a structure to which the pod is attached. Other joining elements can be used in connection with the pod to join it with the blind noted above and/or a variety of other desired structures.

These and other objects, advantages and features of the invention will be more readily understood and appreciated by reference to the detailed description of the invention and the drawings.

DETAILED DESCRIPTION OF THE CURRENT EMBODIMENT

I. Overview

Figure 1:
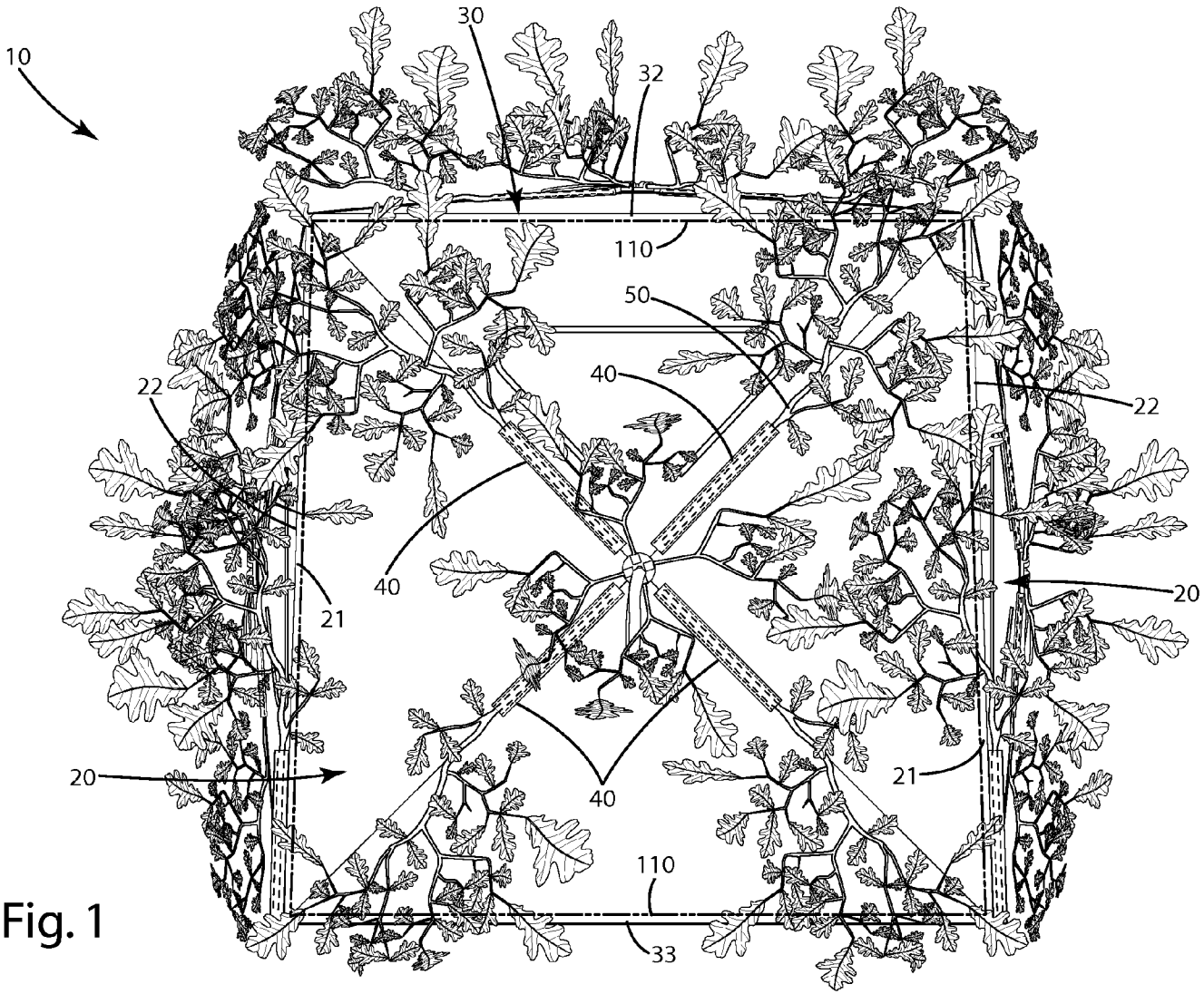
FIG. 1 is a first perspective view of a blind of a current embodiment.
Figure 2:
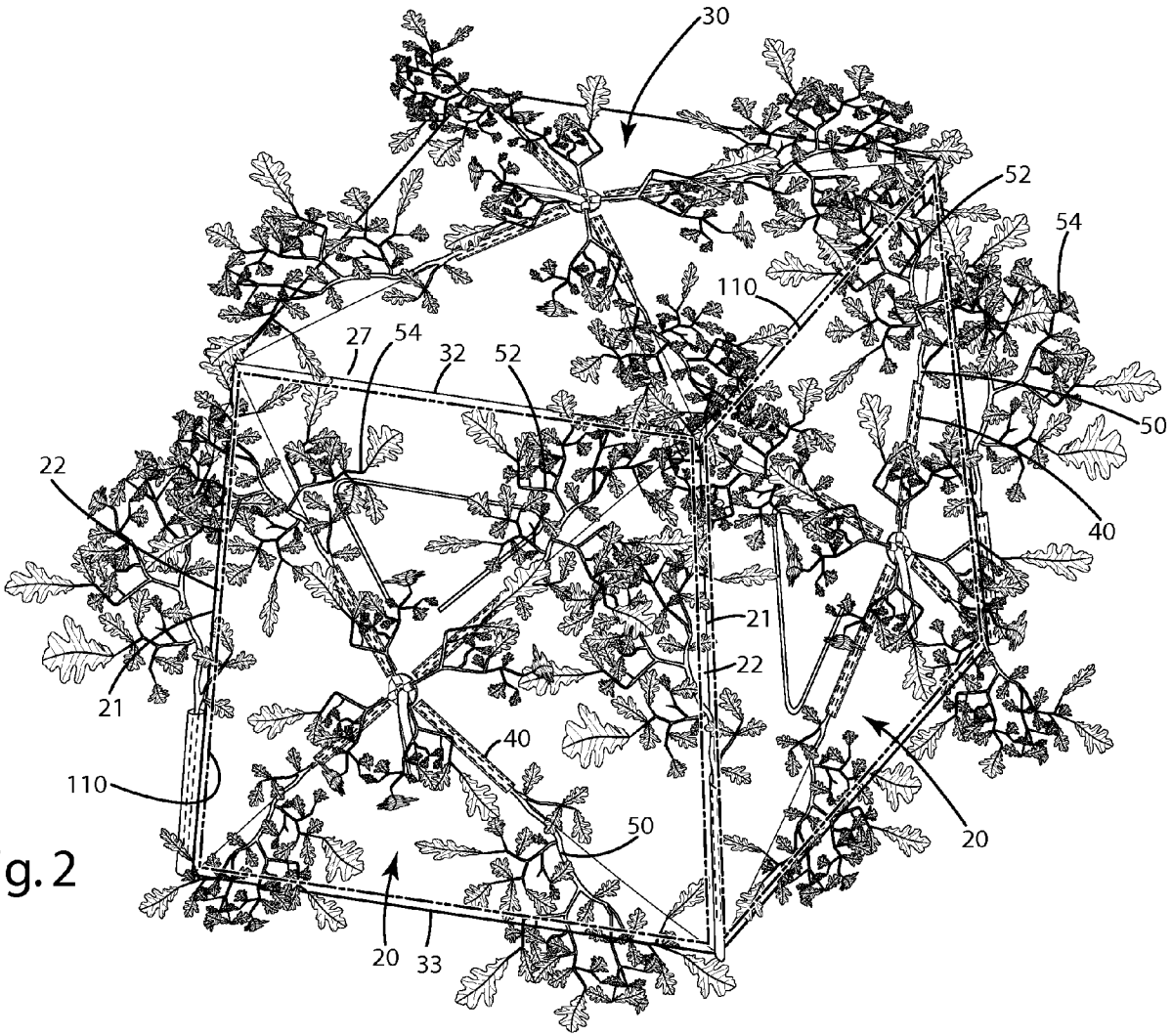
FIG. 2 is a second perspective view of the blind.
Figure 3:
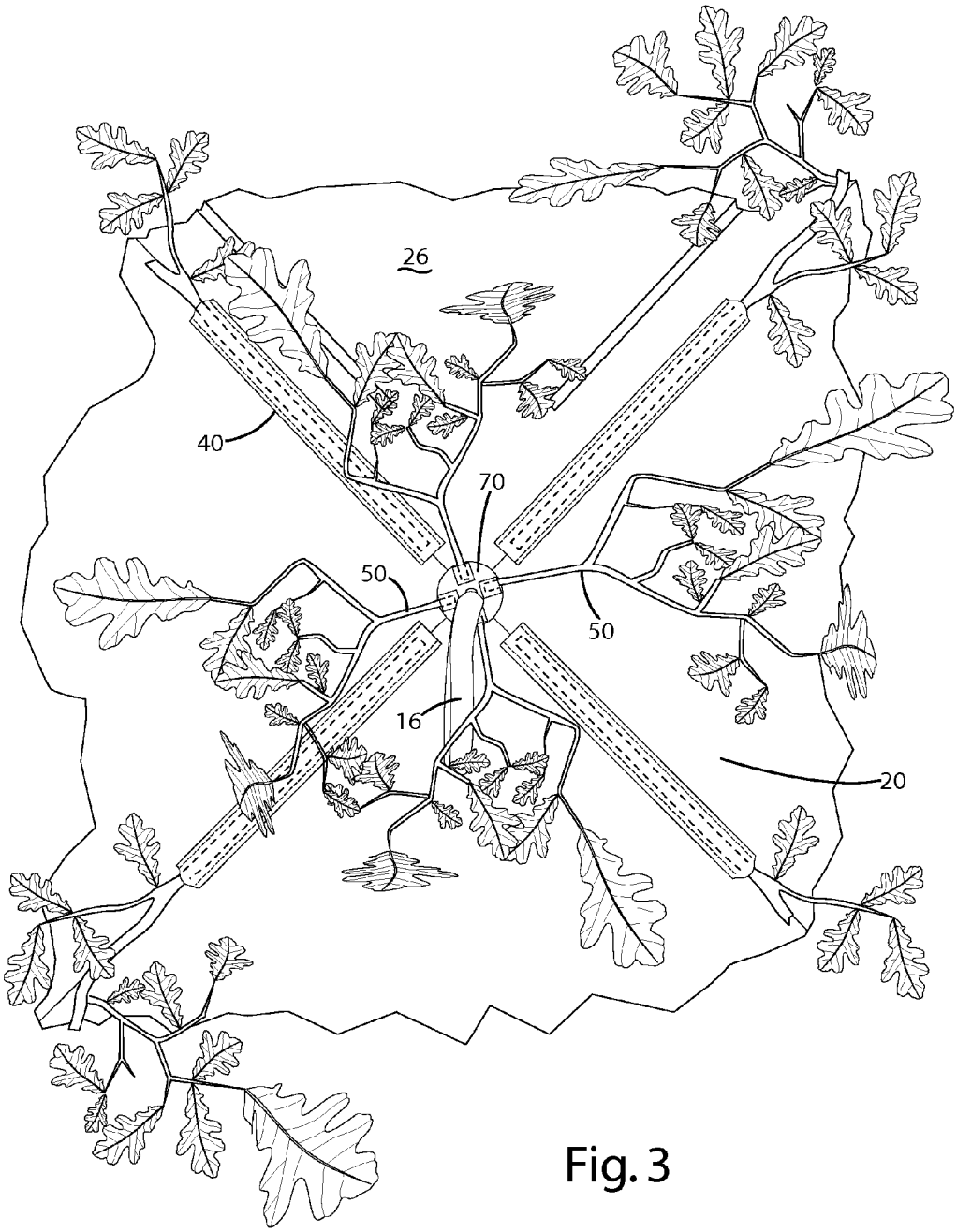
FIG. 3 is a close-up view of multiple positioning members joined with the blind.
Figure 4:
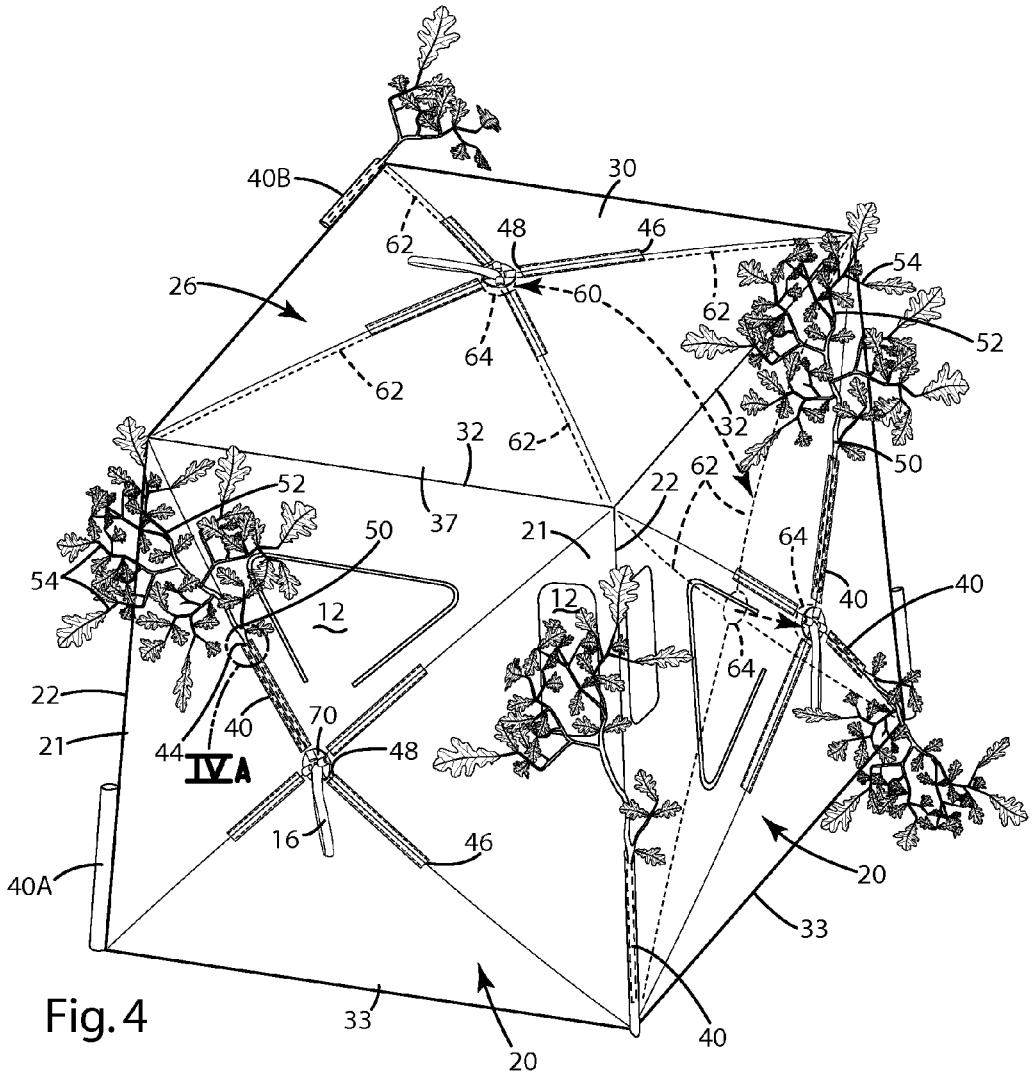
FIG. 4 is a perspective view of the blind in a partially assembled, erected mode.
Figure 5:
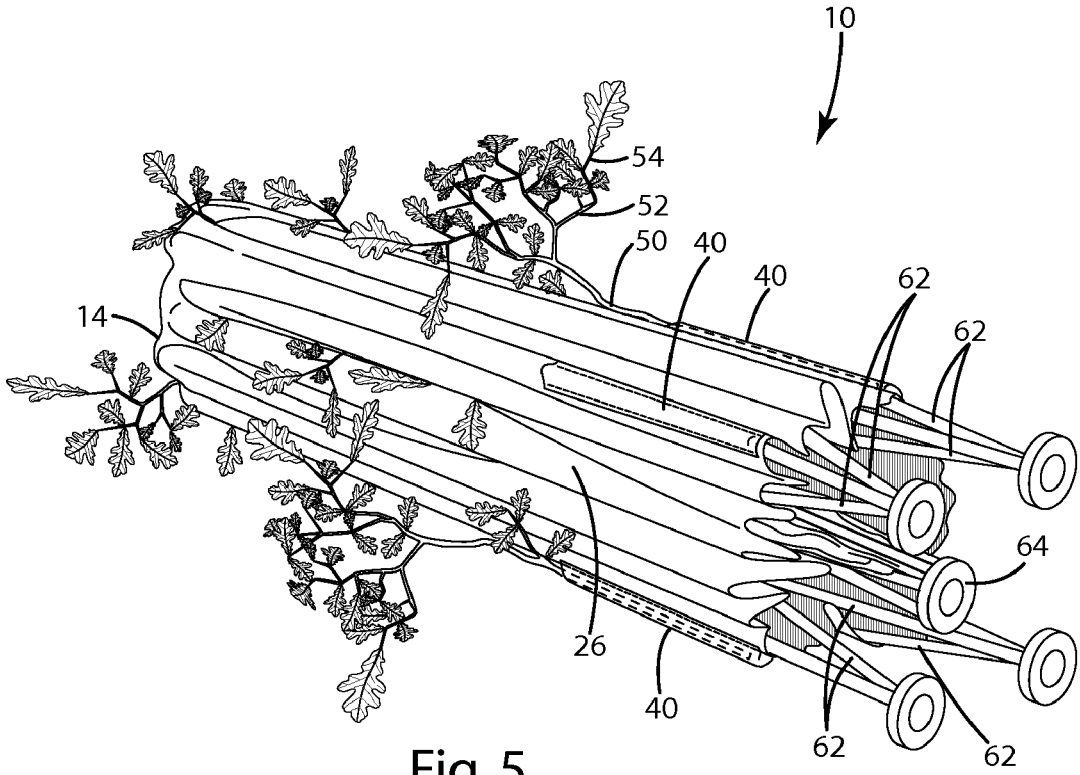
FIG. 5 is a perspective view of the blind in a collapsed mode.

A concealment system of a current embodiment includes an enclosure in the form of a portable, collapsible blind, illustrated in FIGS. 1-2 and 4, and generally designated 10. The blind 10 can include multiple side walls 20 and a roof 30. The side walls 20 can include side edges 21, and can be joined with one another at side wall corners 22. The side walls 20 can be joined with the roof 30 at the roof corners 32, which also can correspond to the upper edges 37 of the walls. The side walls 20 can each also include lower edges 33. The side walls 20 and optionally the roof 30 can be formed from a frame 60 and a material 26 as described below. The frame 60 and material 26, and optionally the sidewalls 20 and/or roof 30, can form a geometric shape, such as a box, pyramid, dome or other geometric shape, when the blind 10 is erected. The side walls and roof can be covered or otherwise include a material 26, which can be a fabric. The material 26 is operable in a taut mode, which is achieved when the blind is erected as shown in FIG. 1, and a relaxed mode, which is achieved when the blind 10 is collapsed, as shown in FIG. 5.

With reference to FIGS. 1 and 4, the concealment system can include positioning members 40 that position simulated arborescent structures 50 relative to the remainder of the blind. For example, these positioning numbers 40 can position the simulated arborescent structures 50 so that they extend beyond the side edges 21, the side corners 22, the upper edge 32, the lower edge 33, the roof edges 37, the roof corners 32 and/or other geometric boundaries or outer peripheries of the blind 10. The arborescent structures can generally break up a pre-defined geometric shape 110 of the erected blind, which again can be formed by the frame and material, or the sidewalls and/or roof, and which is illustrated as a square, box-like shape, so that the blind readily blends into a natural background such as that in a woodland, swamp, prairie, cornfield, desert, or other setting. The positioning members 40 can be generally joined with the material 26, the various sidewalls 20, the roof 30 and/or other components of the blind 10.

As shown in the embodiments of FIGS. 6-12 the concealment system can include a concealment pod 70. This pod 70 can include a base 72 to which joining element 74 is joined. The base 72 can accommodate a plurality of simulated arborescent structures 50. The joining element 74 of the pod 70 can be configured to include a fastening device so that the pod can be joined with the blind 10 noted above, or any other equipment or structure as desired. With this type of modularity, the pod can be joined with a variety of items to provide effective concealment of those items. The above constructions will be described in more detail below.

II. Construction

With reference to FIGS. 1-6, the concealment system and in particular, the blind 10, will now be described. The blind can include side walls 20 and a roof 30 that are configurable in a collapsed mode and in an erected mode. The collapsed mode is show in FIG. 5, and the erected mode is shown in FIGS. 1-4. In the collapsed mode, the collapsed blind 10 is more easily transported, because it is less bulky, and can be packed into a sack or bag.

The side walls 20 as illustrated are generally square, however, they may take on a variety of different geometric shapes, such as circular, triangular, trapezoidal, or other polygonal shapes. Each side wall can include opposing side edges 21, an upper edge 32 and an opposing lower edge 33. The side edges 21 can be joined with one another at side corners 22. Generally, the sidewalls can be joined with adjacent sidewalls at the side corners 22. The upper edges 32 can be joined with the roof 30 at roof corners 32. Although shown as being generally square, the sidewalls and/or roof can be of a round, circular, oval, triangular, or other geometric shape, depending on the desired configuration of the erected blind. Optionally, where the side walls are of a rounded or circular configuration, they still may be joined at corners, where the adjacent sidewalls meet. Further optionally, the different edges, for example, the side edges, upper edges, lower edges, roof edges, as well as the different corners, for example, the side corners and roof corners, can be contiguous with one another. Moreover, these structures can transition smoothly to one another so that there may be no notable delineation where one corner and/or edge ends and another starts.

The side walls 20 and roof 30 can include a material 26, such as a canvas, which can be generally opaque. The material can be camouflage or of another color that easily blends in with the surroundings for which the blind is designed for use. The material can be joined with the walls 20, roof 30 and/or frame 60 via stitching or loop structures. The material 26 can be operable in a taut mode and a relaxed mode. In the taut mode, which corresponds to the blind being erected, the material 26 can be in a stretched or at least partially stretched state, or alternatively, expanded to a larger size or dimension. In the taunt mode, the material along with the frame can provide the blind with a given geometric shape, such as the cube or square or box-shape 110 illustrated in FIGS. 1 and 2. In the relaxed mode, the material can be generally unstretched, only partially stretched, or generally reduced in size or dimension, and collapsed upon itself as illustrated in FIG. 5, so that the blind 10 can be packaged and transported easily.

The blind 10 can include a frame 60 as illustrated in broken lines in FIG. 4. This frame can include multiple support members 62 which can be in the form of elongated bars or members of other structures. As shown in FIGS. 1,2 and 4, a group of two or more support members 62 can be joined at their ends, centrally at a hub 64, generally in the form of a cross tilted sideways when the frame is in its erected mode. The support members can generally project outwardly and radially from the hub 64. The different groups of support members and respective hubs can independently form the respective sidewalls 20 and roof 30 where included in the blind 10. This type of frame construction and its operation is generally described in U.S. Pat. No. 5,628,338 to Stumbo, which is hereby incorporated by reference in its entirety.

The support members 62 also can be collapsible relative to one another to configure the frame 60 in a collapsed mode, and thus collapse the blind 10. In the collapsed mode, the material 26 can attain a relaxed mode, as shown in FIG. 5. The support members 62 also can be lockable or otherwise positionable relative to one another to configure the frame 60 in the erected mode, where the material 26 attains the taut mode.

As illustrated in FIG. 4, the blind 10 can be configured to define multiple windows 12 through which a hunter or observer can hunt or observe game or conduct surveillance or viewing of persons, animals or things. These windows 12 can be configured in a variety of locations, and can include an optional cover or see through mesh. Although not shown, the blind can also include a door or opening through which the user enters and exits the blind. This opening can be configured in a variety of manners, for example, in the form of a horizontal or curved (e.g., "C" shaped) or angled zipper to provide easy access to the interior of the blind.

With reference to FIGS. 3, 4, 4*a* and 5, the positioning members 40 will be described in more detail. As shown there, a positioning member 40 can generally be in the form of a web, sheet, piece of material or a sleeve that extends along, and is aligned with a support member 62 of the frame 60. As shown in FIG. 4, positioning members 40*a* can be aligned with and optionally parallel to a side corner 22 or side edge 21 of the blind. Other positioning members 40*b* can be joined with and/or parallel to the upper edge 32 or the roof edge 37 or the lower edge 33 of the sidewalls, or other portions of the roof, sidewalls or other blind components if desired. Of course, the positioning members need not be aligned with any particular structure of the blind, but instead can be randomly placed on the outer surface of the blind to achieve a desired appearance when the simulated arborescent structures are joined with the members.

Figure 4A:
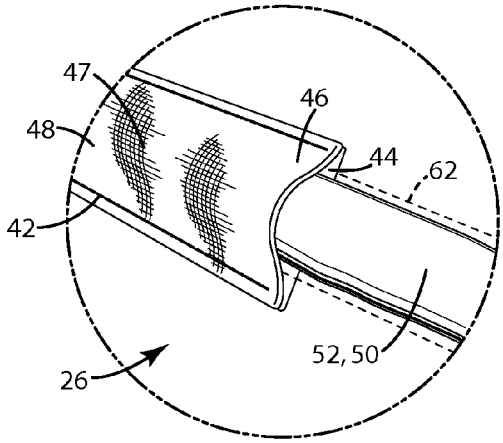
FIG. 4A is a close-up view of a positioning member.

As shown in FIGS. 4 and 4A, each positioning member can include a first end 46 and a second end 48 opposite the first end. The second end 48 can be adjacent or otherwise near the hub 64 of the frame 60, while the first end 46 can be distal from the hub 64, closer to one of the side corners 22, side edges 21, upper edges 32, lower edges 33, roof corners 32 or roof edges 37. The positioning member 40 can be in the form of an elongated web that is sewn to the material 26 of the blind with stitching 42. The stitching 42 can be spaced and separated to fasten down the opposing edges of the web, with a middle portion 47 of the web remaining free. Thus, the middle portion 47 can form a sleeve, pocket or aperture to which the arborescent structure 50, and more particularly a limb 52 of a simulated arborescent structure, can be inserted or otherwise placed. Further, the positioning member 40 can define an opening 44 within which the arborescent structure 50 is inserted.

In general, the positioning members 40 can be configured so that the simulated arborescent structure, in particular the limb 52, can be inserted into and easily withdrawn from the positioning member. The insertion and withdrawal can be performed manually or with an appropriate tool. Optionally, the positioning member 40 can be configured so that the simulated arborescent structure 50 is generally easily removed so that these structures can be manually replaced with ease. Where desired, the simulated arborescent structures can be inserted and locked in place in the positioning member. For example, the simulated arborescent structure can be sewn in place in the positioning member, or can include a locking feature, such as an enlarged portion, that locks with a corresponding feature on the positioning member to fixedly join the structure with the positioning member.

As best illustrated in FIG. 4, the positioning member can orient the simulated arborescent structure 50, generally pointing the limb 52 outward toward the side corners 22, side edges 21, upper edge 32, lower edge 33, roof corner 31, or any other periphery of the blind or frame, so that the geometric shape 110 formed by the frame and the material is visually broken up when the blind is in the erected mode. Optionally, the positioning member can engage the limb, where the limb is at least partially rigid, to hold the limb in a fixed position relative to the erected blind 10.

The positioning member can project the limb 52 and/or leafy parts 54, or the simulated arborescent structure in general, outward and beyond the boundaries of the blind 10, and more particularly, the frame and material. For example, the positioning member 40 can engage the respective simulated arborescent structures 50 to position the limbs so that the limbs extend along at least a portion of at least one of the sidewalls 20, the sidewall corner 22, the side edges 21, the upper edge 32, the roof 30, the roof edge 37 and/or the roof corner 31. The positioning member 40 also can position the simulated arborescent structures so that at least a portion of the limb 52 and/or the leafy part 54 extend beyond the geometric shape formed by the material 26 and the frame 60 a preselected distance to visually break up the geometric shape.

As shown in FIGS. 1, 2 and 4, at least a portion of the limb 52 and/or one or more leafy parts of a simulated arborescent structure 50 can extend beyond the sidewalls 20, the sidewall corner 22, the side edges 21, the upper edge 32, the roof edge 37, the roof 30 and/or the roof corner 31 at least about 1, 2, 3, 4, 5, 6, 7, 8, 9, 10, 11, 12 inches, and optionally at least about 1, 2, 3, 4 or more feet, or other distances, as desired. With the over-extended limbs 52 and/or leafy parts 54, the rough geometric shape 110 of the frame and the material of the erected blind 10 is difficult to view and perceive, and thus the erected blind has a brushed-in appearance is difficult to perceive by game and humans. Optionally, with such a construction, the hard lines of the silhouette of the blind, when viewed from different perspectives, are broken-up. In turn, the silhouette of the frame and material can also be difficult to perceive.

Referring to FIG. 4, the arborescent structures 50 can be configured so that the limbs 52 are at least partially rigid and self supporting. Accordingly, the limbs 52 can support the leafy parts 54 so that those parts are suspended at a location distal from the geometric shape formed by the frame and material of the erected blind 10. The location of the leafy part can be at least about 1, 2, 3, 4, 5, 6, 7, 8, 9, 10, or 11 inches, or optionally 1, 2, 3, 4 or more feet, or other distances from the sidewall corner 22, the side edges 21, the upper edge 32, the roof edge 37, the roof 30 and/or the roof corner 31. In turn, the geometric shape is visually broken by the plurality of the simulated arborescent structures.

Although shown as a web or sleeve, the positioning member 40 can take on a variety of alternative shapes. For example, the positioning member 40 can be a series of loops sewn to the material 26 or otherwise attached to the frame 60, corners 22 or edges 32, 33. These loops can be closed loops, or they can be openable and closeable. For example, they can include hook and loop fasteners that enable the loops to be opened and closed to readily exchange or include simulated arborescent structures 50 on the blind.

Optionally, the positioning members 40 can be in the form of plastic tubes 40*a* (FIG. 4) that are generally tubular, for example, cylindrical in shape and joined with the various elements of the frame 60 around the side corners 22 and/or the edges 21, 32, 33, 37 of the blind and/or other components of the blind. The tubes can include a set screw (not shown) to engage the limbs 52 when inserted therein as shown in FIG. 5, the positioning members 40 can radially extend generally from the region in which the hub 64 of the frame 60 is positioned on each of the walls 20. As show in FIG. 4, however, the positioning members can be aligned with other edges or corners of the walls and/or roof. Although not shown, the positioning members can be randomly placed on the walls 20 and/or roof 30 if desired to achieve a desired concealment configuration.

Further optionally, the positioning members 40 can be in the form of clips including a base that attaches to the material 26, walls 20, roof 30 and/or the various elements of the frame 60. To the base, a moveable clip or arm can be joined, where that moveable clip or arm is adapted to fold over or otherwise engage the limb 52 of the arborescent structure 50. The clip or arm can be configured to lock to the base thereby constraining and holding the arborescent structure 50 in the desired orientation relative to the blind 10. A variety of other structures are contemplated for the positioning members.

The simulated arborescent structures 50 can take on a variety of forms, but in general, these structures include a limb structure 52 that is joined with multiple leafy parts 54. A simulated arborescent structure, as used herein, refers to a structure that resembles a tree, or tree parts, or other plants, such as corn, other crops, cattails, other marsh plants, brush and/or grasses. The limb of the simulated arborescent structure can resemble a limb of a tree, a stalk of a corn plant, a stalk of a cattail, and/or a variety of other components of other plants. The leafy parts can resemble the leaves of a tree or bush, the leaves of a corn plant, the blades of cattails or other marsh plants, and/or a variety of other components of plants.

The limb can be a rigid or semi rigid element that is also optionally manually bendable and conformable to retain a desired shape or configuration when manually bent to that configuration. The limb can also be an elongated structure that is generally self supporting, that is, when one end or portion is supported by another structure, for example, a positioning member, the remainder of the limb projects outwardly from the point or points of support, with that remainder of the limb holding itself up. The limbs 52 can also include multiple secondary limbs to which the leafy parts are directly attached.

The limb can be joined with the leafy parts 54 so that the leafy parts can be oriented in a variety of orientations relative to the main limb or limbs. The leafy parts can be generally flexible and moveable. The leafy parts can also include a wire to which a fabric is sewn, joined, or otherwise attached. Optionally, the leafy parts can include a wire or other support structure to which a thin layer of sheet-like material, such as a plastic, is molded. Further optionally, the leafy parts can be void of any internal support structures, like a wire or bar, and can be formed from flexible fabric or material, or from a material that can support the structure of the leafy part in a desired configuration.

The limb can be constructed from a metal wire or malleable, bendable bar that is embedded in an exterior plastic overmolded material, or an elongated bendable composite structure, or a wire or bar sheathed in an outer plastic or fabric or other material. Alternatively, the limb can be constructed from a polymer or composite material that is malleable and bendable, and which optionally can retain a shape or configuration into which it is bent.

Figure 13:
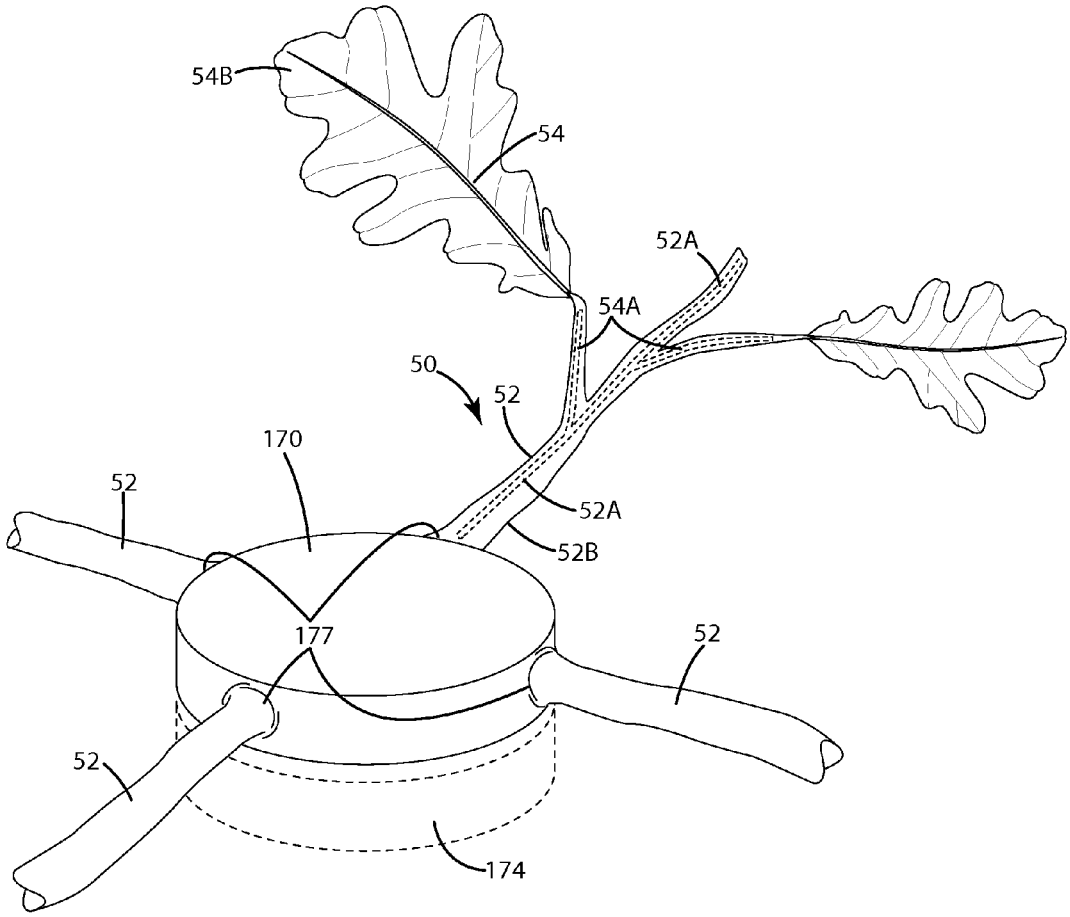
FIG. 13 is a top perspective view of a first alternative embodiment of the concealment pod.

An optional construction of the simulated arborescent structures 50 is shown in FIG. 13. There, as described above, the arborescent structure 50 includes a limb 52 and one or more leafy parts 54. A wire 52*a* of a first hardness is disposed within the limb 52 and extends as shown in the broken lines generally in the direction of the limb. The wire 52*a* can be encapsulated in a plastic or other material 52*b* that generally conceals the wire there within. This material can be any polymer, tape, fabric, coating or combination of the foregoing. The wires 54*a* of the leafy part 54 can extend to and/or adjacent the wires 52*a* of the limb 52. The wires 54*a* can also optionally extend outward to the outer perimeter of the leafy part 54. The leafy part 54 can also include a fabric, plastic or other material 54B forms the leaf or other structure of the simulated arborescent structure.

The wire or bar from which the limb is constructed can be of a hardness that is less than the hardness of the wire in the leafy parts. For example, the limb wire or bar can be constructed from a metal wire, and the leafy part limb or wire can be constructed from a harder spring steel. With this construction, the leaves readily spring back or "pop up" so that they achieve a generally natural appearance without much, if any, manual manipulation by a user when setting up the concealment system. One suitable construction for the simulated arborescent structures 50 is described in U.S. Pat. No. 7,371,442 to Pitman, which is hereby incorporated by reference in its entirety.

As further explained above, the simulated arborescent structures used in conjunction with the blind can be provided in a variety of colors and/or camouflaging patterns. For example, the arborescent structures can include multiple fall-colored parts if the blind is to be used for fall whitetail hunting. Alternatively, the arborescent structures can be provided with greener leafy parts if the blind is intended to be used for spring turkey hunting. Further, the leafy parts can be exchanged for other structures, such as long blades of grass or cattail-like blades if the blind is to be used in a marshy environment. The leafy parts also can be substituted with simulated corn leaf structures if the blind is to be used in a standing or cut corn field in whitetail or goose hunting. A variety of other leafy parts can be substituted depending on the application.

Optionally, in some cases, a variety of different colored and shaped arborescent structures can be marketed and sold with a blind or concealment system herein so that a user can match the arborescent structures with the particular environment within which they will be hunting or observing wild life to ensure appropriate concealment and brushing in of the system. For example, in one set of provided structures, the limb can simulate a tree limb and the leafy part can simulate a leaf. In another set, the limb can simulate a cattail stalk, and the leafy part can simulate a cattail blade. In yet another set, the limb can simulate a corn stalk, and the leafy part can simulate a corn plant leaf environment in which the blind is used.

The blind 10 can be erected when the frame and material are configured in an erected mode as shown in FIG. 4, and can be collapsed when the frame and material are in a collapsed mode as shown in FIG. 5. In the collapsed mode of FIG. 5, the positioning members 40 (which are shown with a portion of the material 26 removed to expose those elements) can be configured to align the arborescent structures 50 generally in parallel with one another and the support members 62. In this configuration, the limbs 52 project outward, and "up" toward the "top" or end 14 of the collapsed blind 10. If the arborescent structures are of significant length, the leafy parts 54 and portions of the limbs 52 of the blind 10 can extend beyond the top or end 14 a preselected distance, for example, at least about 1, 2, 3, 4, 5, 6, 7, 8, 9, 10, or 11 inches, or optionally 1, 2, 3, 4 or more feet, or other distances, when the blind is collapsed, as desired. Of course, the arborescent structures can be configured so that they do not extend beyond the top or end 14 of the collapsed blind as well.

A method of using the blind 10 is also provided herein. With reference primarily to FIGS. 4 and 5, the method can include several steps. To begin, the blind 10 described in the embodiments above is provided. A user can erect the blind 10 so that the frame 60 and its support members engage the material 20. In doing so, the material 26 transitions from a relaxed mode to a taut mode. The frame also transitions from a collapsed mode to an erected mode. When the frame is fully erected, the material 26 and the frame 60 form a geometric shape, which as shown in FIG. 4 is a box or cube like shape.

During the erecting step, many of the simulated arborescent structures 50, and in particular, the leafy parts 54 and/or limbs 52, automatically extend beyond one or more of the sidewalls, the upper edge, the side edge, the side corners, the roof, the roof edge, the roof corners and the support members a pre-selected distance. This extension of the structures 50 is primarily due to the positioning members holding the structures 50 in specific orientations relative to the components of the blind as the blind is erected and the different components, for example the sidewalls, the upper edge, the side edge, the side corners, the roof, the roof edge and the roof corners take shape. Optionally, some of the structures 50 extend beyond the geometric shape formed by the frame and the material. Accordingly, some of the leafy parts can be suspended at a location distant from the geometric shape by the limb. The distance can vary, and can be at least about 1, 2, 3, 4, 5, 6, 7, 8, 9, 10, or 11 inches, or optionally 1, 2, 3, 4 or more feet, or other distances.

In another step, the user can use the blind for hunting game, or for watching or photographing wildlife. When the user has completed their activity, they can collapse the frame to a collapsed mode. In so doing, the material returns to a relaxed mode. Further, the simulated arborescent structures 50, and more particularly the limbs 52 of different structures, generally align with one another in parallel. The limbs can also generally align with the supporting members. When the frame is in the collapsed mode, it is configured as shown in FIG. 5. There, many of the simulated arborescent structures 50 extend beyond the top or end 14 the frame and material. Optionally, one or more of the limbs and/or leafy structures can extend beyond the end 14 by at least about 1, 2, 3, 4, 5, 6, 7, 8, 9, 10, or 11 inches, or optionally 1, 2, 3, 4 or more feet, or other distances if desired.

In yet another step, the user can transport the blind 10 to another location for further use or for storage. Because the positioning members 40 engage and hold the simulated arborescent structures 50, those structures remain joined with the blind during the transporting. If desired, the user can place the blind 10 in a pack or bag during the transporting.

Figure 6:
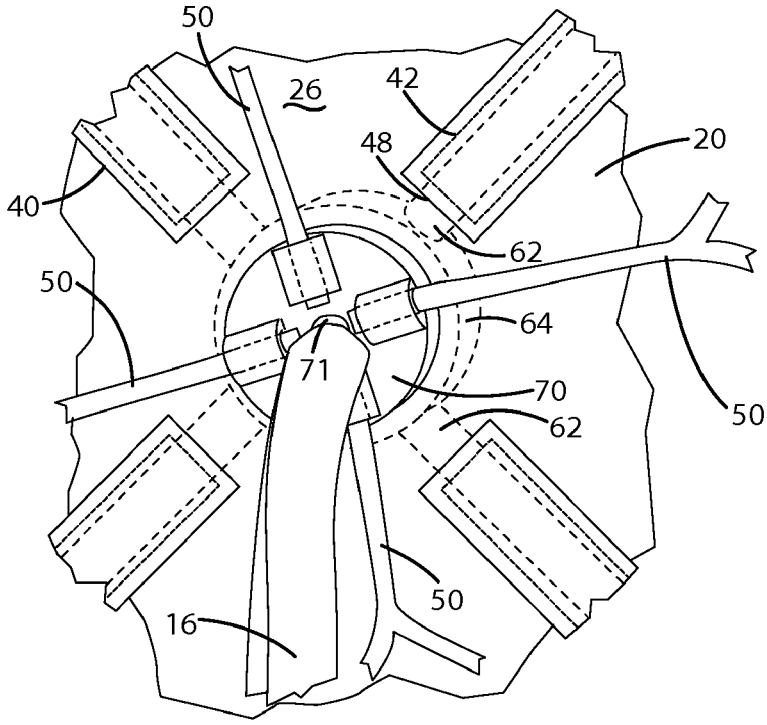
FIG. 6 is a close-up view of the positioning members and a concealment pod joined with the blind near a hub of the blind.

The concealment system described herein can also include a concealment pod 70. As illustrated in FIGS. 6-11, a current embodiment of the concealment pod can take on a variety of configurations. Generally, as shown in FIG. 6, one type of a concealment pod 70 can include arborescent structures 50 extending outwardly therefrom. The concealment pod 70 can be outfitted to include an aperture 71 through which a strap or handle 16 is positioned. The handle 16 can be further generally connected to the hub 64 to erect the respective walls and convert the blind to its erected mode by pulling the framework 60 outward as illustrated in FIG. 5. The pulling action on the hub also can draw the material 26 of the walls and/or roof taut, as explained above.

Referring to FIGS. 7-11, another type of concealment pod can include a base 72 and a joining member 74. The base can include a first side 73 and a second side 75 opposite the first side. Multiple mounting members 76 can be mounted or joined to the first side 73. These mounting members can define bores 77 into which simulated arborescent structures 50 can be inserted. For example a limb 52 can be inserted in the bore 77. The bore 77 can be sized to frictionally receive the limb 52 so that the limb is retained within the mounting member 76. Alternatively, a portion of the limb 52 can be cemented, glued, or otherwise fastened within the bore 77 as desired. For example, the mounting members can include hook and loop fasteners (Velcro®) that can be joined end to end to form a closed loop around a part of the simulated arborescent structure. As another option, the portion of the limb to be inserted into the bore 77 can be partially melted so that when inserted into the bore 77, it bonds at least partially with the base 72.

Figure 7:
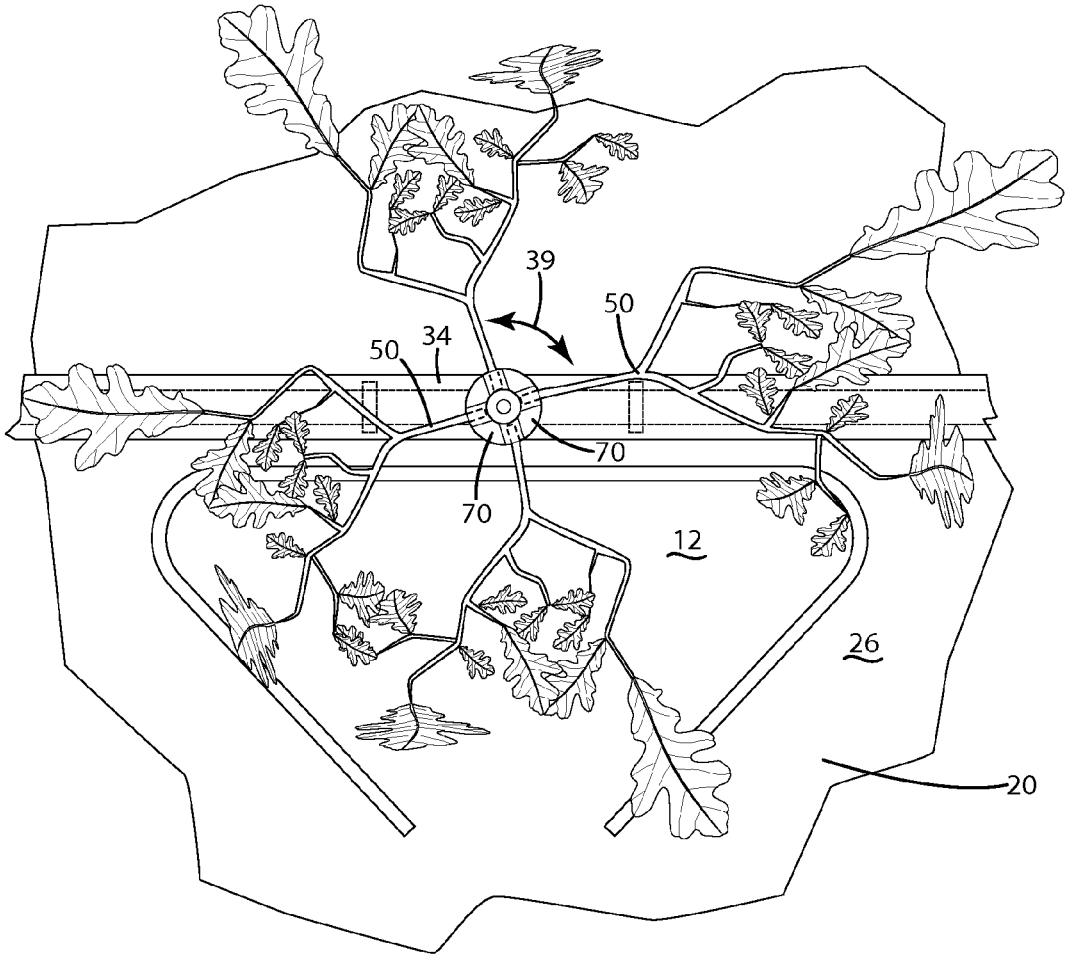
FIG. 7 is another view of the concealment pod joined with the blind.
Figure 8:
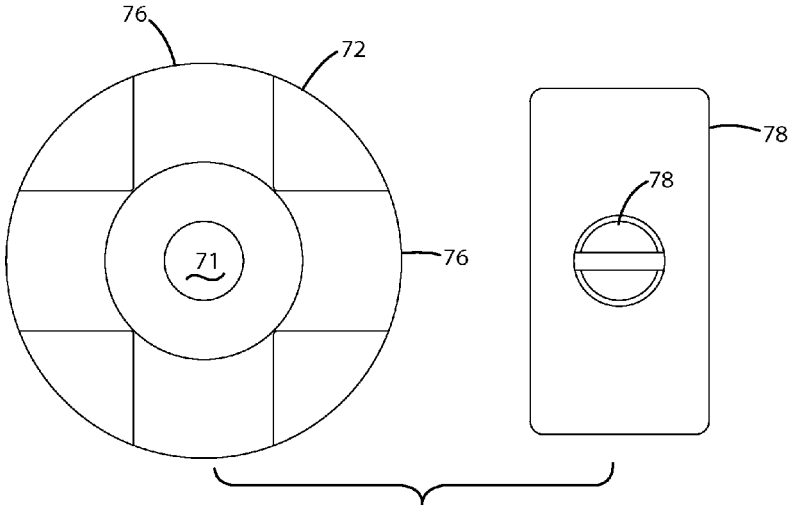
FIG. 8 is a top view of a disassembled concealment pod.
Figure 10:
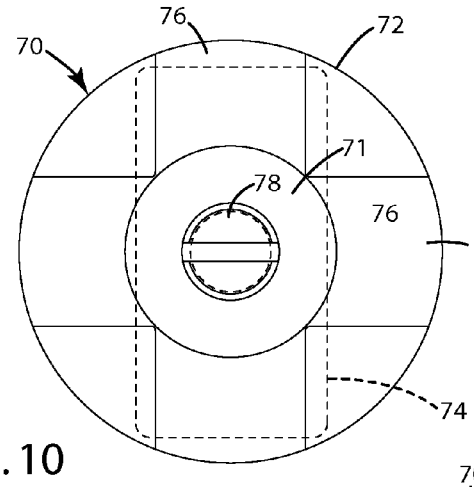
FIG. 10 is a top view of the concealment pod where the base is joined with the joining element.

The base 72 also can define a central aperture 71. The mounting elements 76 can extend radially outward from the central aperture 71, or more generally from the center of the pod. As desired, the mounting members 76 can be oriented in other fashions, for example, they can all be substantially parallel to project the inserted arborescent structures 50 in one or more desired directions. In FIGS. 8-11, the concealment pod 70 can include a joining member 74 that is joined with the base. The joining element can be pivotally, rotatably or otherwise moveably joined to the base so that the base can be rotated or moved to reorient a simulated arborescent structure relative to the blind. For example, as shown in FIGS. 7 and 10, joining element can be joined with or clipped on a brush loop or brush pocket 34. This brush pocket optionally can be in the form of a web intermittently stitched to the material 26, or as additional material or elements sewn or radio frequency welded to the material, or other components of the blind capable of holding an end or other portion of brush or camouflaging structures. Due to the pivotal connection between the joining element 64 and the base 72, the base can be rotated in the direction of the arrows 39 as shown to reorient the arborescent structures in a desired configuration relative to the blind components.

Figure 11:
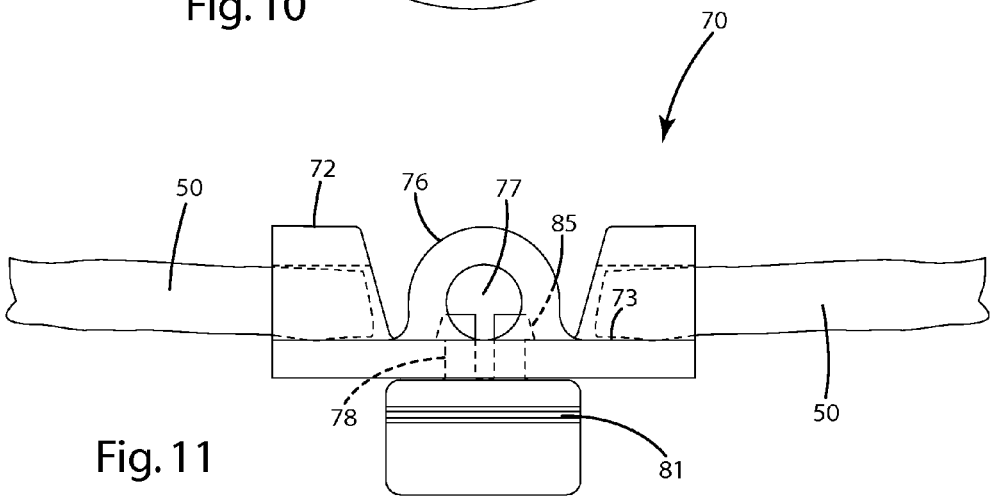
FIG. 11 is a side view of the base of the concealment pod joined with the joining element.

The joining elements 74 also can include a corresponding fastener element or post 78 including resilient members. The post can be topped with a flange 85 so that when the post 78 is inserted into the fastener element of the base, that is, aperture 71, the flanges 85 interlock the joining element 74 to the base 72. The fully assembled interlocking construction is shown in FIGS. 6 and 10-11. As desired, the base 72 can alternatively be configured with the post 85 and the joining element 74 can define the aperture 71, so that the post and aperture simply reverse to effect joining of the base and the joining element 74. Other fastener constructions may be readily substituted for the post and hole fastener elements as desired.

As illustrated in FIGS. 8-11, the joining elements 74 can define a slot or hole 79. This slot 79 can be configured to receive a component of a blind or other structure or equipment to which the concealment pod is desired to be attached. For example, again, as shown in FIG. 7, the slot 79 can be configured to receive the web 34 therethrough. To facilitate entry and insertion to facilitate attachment of the joining element 74, the joining element can further define an opening 81 through which the web 34 or other structure may be inserted to facilitate positioning within the slot 79 to affix the joining element 74 to the structure. A variety of the optional materials and construction can be used to join the joining element 74 with a structure.

Figure 9:
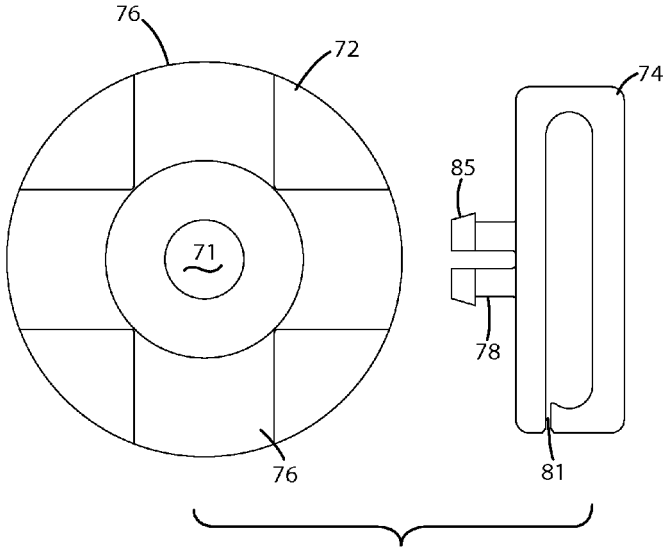
FIG. 9 is another view of the disassembled concealment pod, including an alternative joining element.
Figure 9A:
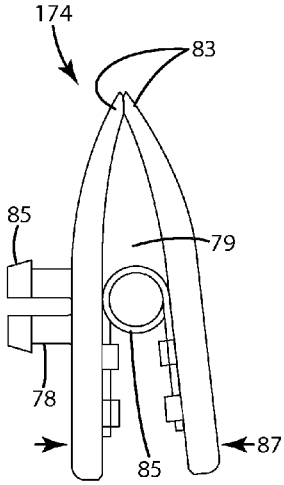
FIG. 9A is a side view of an alternative joining element.

An alternative joining element 174 is shown in FIG. 9A. The alternative joining element 174 can include a corresponding fastener element or post 78 to join with the base 72 shown in FIG. 9, however, the joining element 174 also can include a clamping mechanism including opposing clamping elements 83 that are joined together and yet biased to a closed position (shown) by a spring 85, much like a clamp. When the ends 87 of this joining member are pushed together in the direction of the arrows, the opposite ends open to enable those ends to be positioned over a structure or equipment. When those ends 87 are released, the opposite end clamps to the structure.

Figure 12:
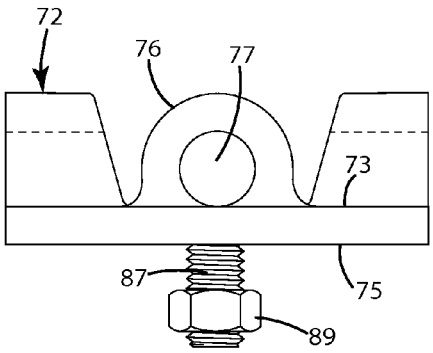
FIG. 12 is a side view of the base with another alternative joining element.

Depending on the application, the joining element 74 can be outfitted with a variety of different structures to join the concealment pod 70 to equipment materials, blinds, and other structures. As another example, the base 72 can be outfitted with a screw or a bolt projecting from the side opposite from the second side 75. As shown in FIG. 12, this bolt 87 can be outfitted to accept a nut 89 so that the base 72 can be joined with a structure defining an aperture sized to receive the bolt or screw 87. As yet another example, the base 72 or joining element 74 can include a magnet so that the pod can be joined to a metal structure. The base or joining element could also include safety pins, earring-style posts, belt-like structures, hook and loop fastener strips, or a tab so that it may be sewn, stapled, tacked, or riveted to a structure. In this manner, the base can join the simulated arborescent structures 50 with virtually any type of structure, thereby offering concealment to the structure.

A first alternative embodiment of the concealment pod is shown in FIG. 13 and generally designated 170. This embodiment is similar to the other embodiments described herein with a few exceptions. For example, the concealment pod includes a base 170 to which limbs 52 of arborescent structures 54 are joined. The ends of the limbs 52 are completely encased and molded over the base 170. This molding over may be achieved by simply placing the ends of the limbs as shown in a mold that mirrors the shape of the base 170 and molding plastic over those ends. The base 170 may also be pivotally attached to a joining element 174 using any of the structures and corresponding fastening elements described here. The joining element can also operate in any of the manners as described herein.

Figure 14:
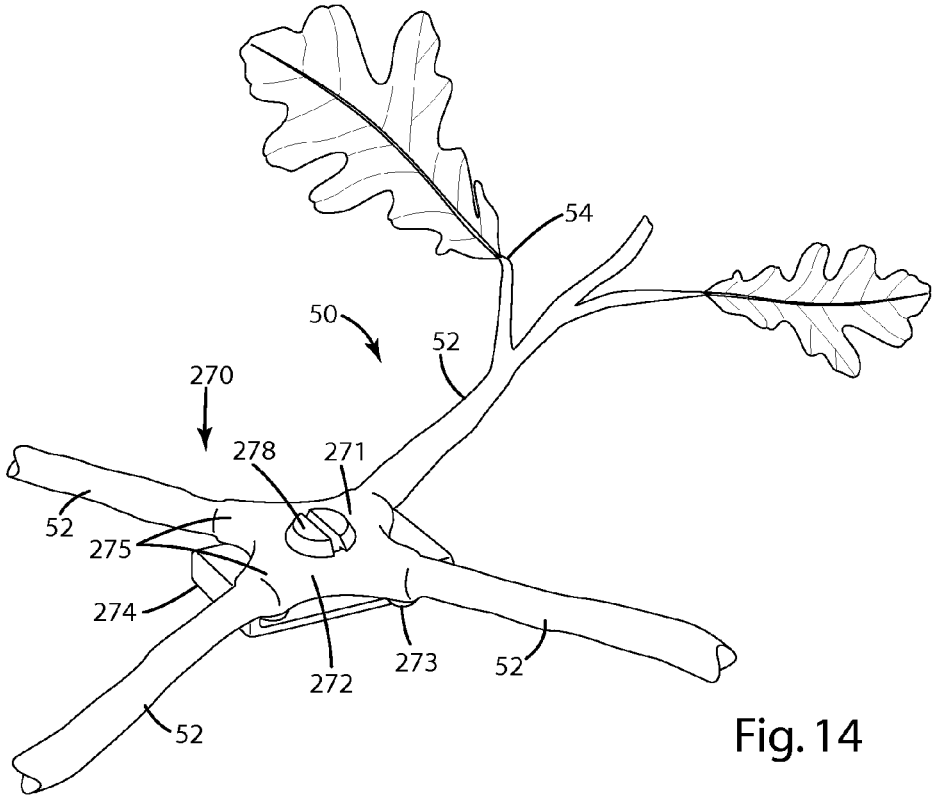
FIG. 14 is a top perspective view of a second alternative embodiment of the concealment pod.
Figure 15:
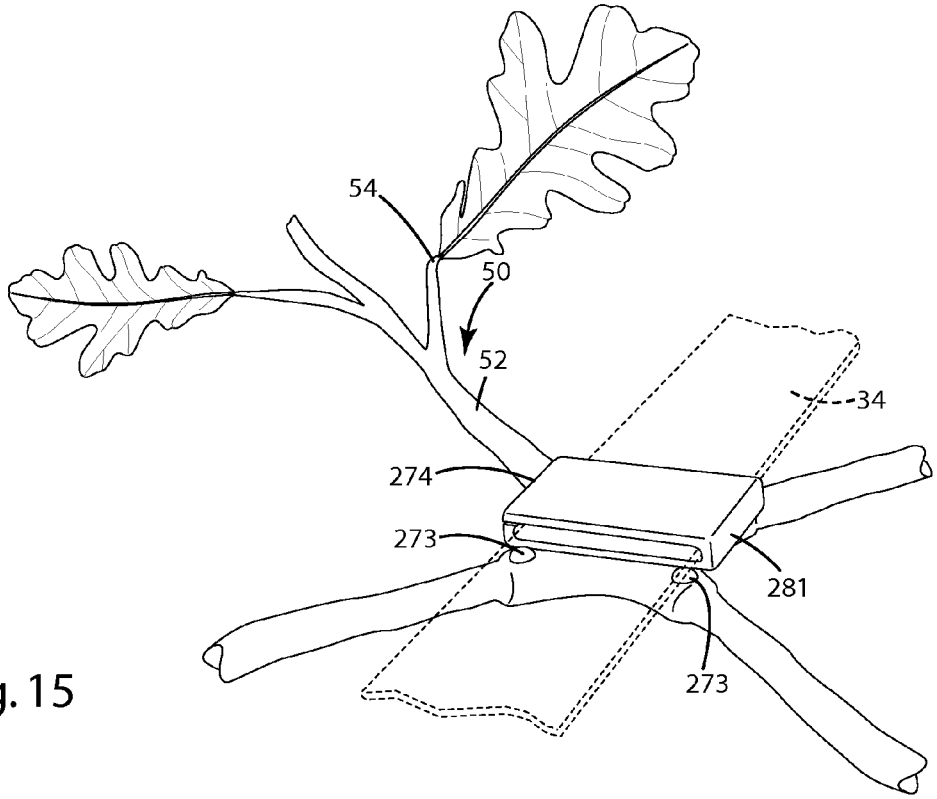
FIG. 15 is a bottom perspective view of the second alternative embodiment of the concealment pod.

A second alternative embodiment of the concealing pod is illustrated in FIGS. 14 and 15 and generally designated 270. This embodiment is similar to the other embodiments herein with several exceptions. For example, as shown in FIG. 14 the base 272 is in the shape of a plus sign or a cross. The arms 275 project radially outwardly away from a center portion at which the fastener element 271, which is generally in the form of an aperture. The corresponding fastener element 278 or post projects upwardly and is locked within the aperture or fastener element 271 joined the joining element 274 with the base 272.

The base 270 can include arms 275 that house or otherwise include portions of the limb 52 of the simulated arborescent structures 50. The joining element 274 and base 272 can be pivotally joined with another as with the embodiments described above. Further, the joining element 274 can include a slot 281 into which a web 34 can be interfitted to join the concealment pod 270 with a web 34 or other structure as shown in FIG. 15.

Because the base 272 and joining element 274, as shown, are pivotally joined with one another, it is possible under high wind conditions that the concealment pod and attached simulated arborescent structures 50 can be prone to spin under the force of the wind. Accordingly, the base and/or joining element can include anti-spin elements 273 which can project outwardly from the base 272 toward the joining element 274. These anti-spin elements 273 can engage one or more surfaces of the joining element 274 to impair or prevent rotation of the base and joining element relative to one another. Although shown merely as bumps or projections, these anti-spin elements 273 can be replaced with external pins or locking features to prevent spinning of the elements relative to one another. Optionally, locking features such as teeth can be built into the fastener element 271 and/or the corresponding fastening element 278 to impair or prevent spinning of the base and joining element relative to one another.

The above descriptions are those of the current embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The embodiments of the invention in which an exclusive property or privilege is claimed are defined as follows:

1. A portable and collapsible blind comprising:

a plurality of sidewalls joined at sidewall corners, at least one of the sidewalls including a side edge, and an upper edge, the upper edge joined with a roof having a roof edge at a roof corner;

a material joined with at least one of the sidewalls and the roof, the material operable in a taut mode and a relaxed mode;

a frame including a plurality of support members, at least two support members joined at one end with a hub with the support members projecting outwardly therefrom, the support members engageable with the material to support the material in the taut mode, the support members collapsible relative to one another to configure the frame in a collapsed mode in which the material is in the relaxed mode and the blind is collapsed, the support members adapted to configure the frame in an erected mode so that the blind is erected, and the frame and material form a predefined geometric shape;

a plurality of simulated arborescent structures, each having an elongated limb that is at least partially rigid, self supporting and manually bendable, and a flexible leafy part joined with the limb; and a plurality of positioning members joined with at least one of the material and the frame, each of the positioning members being at least partially aligned with at least one of the sidewall corners, the upper edge, the side edge, the roof edge, the roof corner and the support members, wherein the positioning members position the limbs in a fixed orientation relative to at least one of the sidewalls, the sidewall corners, the side edge, the upper edge, the roof edge, the roof corner and the support members, so that when the frame is configured in the erected mode and the blind is erected, the limb of at least one of the simulated arborescent structures extends adjacent at least a portion of at least one of the sidewalls, side edge sidewall corner, upper edge, roof edge, roof corner and support members, and so that the at least a portion of the limb extends a preselected distance beyond the at least one of the sidewalls, side edge, sidewall corners, upper edge, roof edge, roof corner and support members and positions at least one leafy part of a simulated arborescent structure distal from the geometric shape formed by the frame and the material of the erected blind to visually break up the geometric shape, whereby the erected blind has a brushed-in appearance that is difficult to perceive by game and humans, wherein the at least two support members and hub are positioned so that the hub is located generally in the center of the at least one sidewall with the support members forming a cross adjacent the at least one sidewall in the erected mode of the frame to hold the material in the taut mode, each of the at least two support members extending along the sidewall from the hub toward a respective sidewall corner, wherein at least one of the simulated arborescent structures extends a preselected distance beyond a first end of the blind when the blind is collapsed and the frame is in a collapsed mode, wherein the plurality of positioning members position the plurality of simulated arborescent structures in a fixed orientation relative to at least one of the sidewalls, the roof, the frame and the support members, so that when the blind is collapsed and the frame is in the collapsed mode, the plurality of limbs of the simulated arborescent structures align generally in parallel with one another, wherein the frame and the support members are configured so that when the blind is collapsed and the frame is in the collapsed mode, the hub is positioned at a second end of the blind, opposite the first end, and distal from the simulated arborescent structures that extend a preselected distance beyond the first end of the blind.

2. The blind of claim 1 wherein the at least one limb extends at least 4 inches beyond at least one of the sidewalls, side edge sidewall corner, upper edge, roof edge, roof corner and support members to support the leafy part in suspended orientation at a location distal from the geometric shape.

3. The blind of claim 2 wherein the at least one limb includes a first wire embedded therein, the first wire having a first hardness, and wherein the at least one leafy part includes a second wire embedded therein that is of a second hardness greater than the first hardness.

4. The blind of claim 1 wherein the geometric shape of the frame and the material of the erected blind is at least one of a cube, a box, and a pyramid.

5. The blind of claim 1 wherein at least one of the simulated arborescent structures extends a preselected distance beyond the first end of the blind when the blind is collapsed and the frame is in a collapsed mode, wherein a first positioning member and a second positioning member of the plurality of positioning members are transversely oriented relative to one another when the blind is erected and the frame is in an erected mode, wherein the first positioning member positions a first leafy part of a first simulated arborescent structure, wherein the second positioning member positions a second leafy part of a second simulated arborescent structure so that the second leafy part overlaps and comingles with the first leafy part.

6. The blind of claim 1 wherein at least two of the plurality of positioning members are aligned in parallel with the at least two support members extending along the sidewall from the hub toward the respective sidewall corners so that said at least two of the plurality of positioning members position the limbs of at least two of the simulated arborescent structures so that they extend away from the hub along the sidewall.

7. The blind of claim 1 wherein at least one of the plurality of positioning members includes an elongate web sewn to the material, the elongate web being generally parallel to at least one of the sidewall corners, side edge, upper edge, roof edge, roof corner and support members.

8. The blind of claim 7 wherein the elongate web includes opposing edges and a middle portion, wherein the opposing edges are sewn to the material, wherein the middle portion is substantially free to form a sleeve within which the limb is inserted.

9. The blind of claim 1 wherein at least one of the positioning members includes a sleeve joined with at least one of the material and the frame, the sleeve including a first end and a second end, the first end nearer the hub than the second end, the second end defining an opening within which the limb is inserted to project the limb and leafy part outwardly away from the hub toward at least one of a side edge and a side corner.

10. The blind of claim 1 wherein at least one of the positioning members includes a loop through which the limb is inserted.

11. The blind of claim 1 wherein each of the plurality of sidewalls and the roof each include four support members extending radially from a hub centrally located relative to the respective sidewalls and the roof when the frame is in the erected mode and the blind is erected, wherein two of the four support members extend from the hub to corresponding upper sidewall corners, wherein another two of the four support members extend from the hub to other corresponding sidewall corners.

12. The blind of claim 11 wherein the four support members extending radially from the hub of each of the respective sidewalls forms a sideways tilted cross when the blind is erected.

13. The blind of claim 1 wherein the plurality of positioning members extend substantially along the sidewalls, distal from the side edge.

14. A portable and collapsible blind comprising:

a plurality of adjacent sidewalls, each sidewall including a side edge with the side edges of adjacent sidewalls joined with one another at a sidewall corner, at least one sidewall including an upper edge, a roof;

a material joined with the side walls and the roof, the material operable in a taut mode and a relaxed mode;

a frame including a plurality of support members and a plurality of hubs, the plurality of support members adapted to configure the frame in an erected mode, in which the material is in the taut mode, in which the frame and material form a predefined geometric shape, and in which the blind is erected, the support members being collapsible to configure the frame in a collapsed mode, in which the material is in the relaxed mode and in which the blind is collapsed, wherein each sidewall includes at least four support members of the plurality of support members and at least one hub of the plurality of hubs, the at least four support members extending from the at least one hub toward a respective sidewall corner, the at least one hub being centrally located on the sidewall when the frame is in the erected mode and the blind is erected;

a plurality of simulated arborescent structures, each having a limb and a leafy part joined with the limb; and a plurality of positioning members joined with at least one of the material and the frame, the plurality of positioning members engaging the plurality of simulated arborescent structures to position the limbs so that the limbs extend along at least a portion of at least one of the sidewalls, side edge, sidewall corner the roof and the upper edge, and to position the simulated arborescent structures so that at least a portion of the limbs and the leafy part extend beyond the geometric shape formed by the material and the frame a preselected distance to visually break up the geometric shape, whereby the erected blind has a brushed-in appearance that is difficult to perceive by game and humans.

15. The blind of claim 14 wherein the at least four support members of each sidewall form a sideways tilted cross, wherein two of the at least four support members extend to two respective opposing lower sidewall corners.

16. The blind of claim 14 wherein at least one positioning member positions at least one simulated arborescent structure so that the limb projects substantially downward and so that the leafy part projects substantially downward toward a ground surface.

17. The blind of claim 14 wherein the at least a portion of the limb and the leafy part extend at least 4 inches beyond the geometric shape formed by the frame and the material, wherein at least a portion of the leafy part is suspended in a location distal from the geometric shape.

18. The blind of claim 14 wherein a first positioning and a second positioning member of the plurality of positioning members are oriented transversely with one another along a sidewall, wherein the first positioning member positions a first leafy part of a first simulated arborescent structure and the second positioning member positions a second leafy part of a second simulated arborescent structure so that the second leafy part overlaps and comingles with the first leafy part of the second simulated arborescent structure.

19. The blind of claim 14 wherein the plurality of the positioning members are aligned with the at least four support members so that the plurality of positioning members generally form a sideways tilted cross, wherein the plurality of positioning members position a plurality of simulated arborescent structures along the sidewall so that the plurality of simulated arborescent structures project generally radially outwardly from the at least one hub along the sidewall.

* * * * *